US006031189A

United States Patent [19]

Watanabe et al.

[11] Patent Number: 6,031,189

[45] Date of Patent: Feb. 29, 2000

[54] KEYBOARD DEVICE

[75] Inventors: Kazutoshi Watanabe; Tsuyoshi Narusawa, both of Fukushima-ken, Japan

[73] Assignee: Alps Electric Co., Ltd., Tokyo, Japan

[21] Appl. No.: 08/908,082

[22] Filed: Aug. 11, 1997

[30] Foreign Application Priority Data

Aug. 21, 1996 [JP] Japan ..... 8-238436

[51] Int. Cl.[7] ..... H01H 9/25

[52] U.S. Cl. ..... 200/5 A; 200/333

[58] Field of Search ..... 200/242, 253, 200/245, 294, 333, 512–517, 5 A, 237–251

[56] References Cited

U.S. PATENT DOCUMENTS 5,280,147 1/1994 Mochizuki et al. ..... 200/344
5,799,772 9/1998 Sanda et al. ..... 200/344

*Primary Examiner*—Michael L. Gellner
*Assistant Examiner*—Nhung Nguyen
*Attorney, Agent, or Firm*—Brinks Hofer Gilson & Lione

[57] ABSTRACT

Disclosed is a keyboard device wherein arm portions formed at an interval are provided at one end or at the other end of the first or second lever section and wherein a connecting section for connecting the end portions of these arm portions is provided at the end of these arm portions, this connecting section being engaged with the engagement section of the support member or the key top, whereby the strength of the end portions of the arm portions increases, and the deflection of the arm portions can be reduced, so that the inclination of the key top when it is depressed decreases, thereby providing a keyboard device having a satisfactory operability.

4 Claims, 4 Drawing Sheets

KEYBOARD DEVICE

BACKGROUND OF THE INVENTION

1. Field of the Invention

The present invention relates to a keyboard device suitable for use in an input/output device of a word processor, a personal computer or the like.

2. Description of the Related Art

As shown in FIGS. 5 through 7, in a conventional keyboard device used in such an input/output device, a switch board 52 consisting of a flexible insulating material provided with a circuit (not shown) is placed on an insulating board 50 provided with a conductor (not shown) through the intermediation of a plate-like spacer 51 consisting of an insulating material having a hole 51*a* to thereby form a switch section.

A support member 53, which is formed of synthetic resin, is equipped with two holding sections 53*a* having a hole, two engagement sections 53*c* having a slide groove 53*b*, and a hole portion 53*d* provided between the holding sections 53*a* and the engagement sections 53*c*. These members constitute one set, and a plurality of such sets are formed. This support member 53 is placed on the switch board 52.

A substantially H-shaped first lever section 54, which is formed of synthetic resin, has at its ends pairs of arms 54*c* and 54*d* having round protrusions 54*a* and 54*b* at their ends. In the central portion of the first lever, there are provided outwardly protruding shaft members 54*e*. The protrusions 54*b*, which are engaged with the engagement section 53*c* of the support members 53, are slidable within the slide grooves 53*b* and on the support member 53.

Each one of pair of second lever sections 55 has at its ends round protrusions 55*a* and 55*b*, and a recess 55*c* provided between the protrusions 55*a* and 55*b*. The protrusions 55*a* are fitted into the holes of the holding sections 53*a*. Further, the shaft members 54*e* of the first lever section 54 are fitted into the recesses 55*c*. The first and second levers 54 and 55 cross each other and combined so as to be rotatable.

A key top 56, which is formed of synthetic resin, has on the back side two holding sections 56*a* each having a hole and two engagement sections 56*c* each having a slide groove 56*b*. The protrusions 54*a* of the first lever section 54 are rotatably supported by the holding sections 56*a*. Further, the protrusions 55*b* of the second lever sections 55 are slidably held by the engagement sections 56*c*, whereby the key top 56 is mounted on the first and second lever sections 54 and 55.

A dome-like elastic member 57 consisting of insulating rubber is positioned inside the hole portion 53*d* of the support member 53 and, in this condition, placed on the switch board 52, with the forward end of the elastic member 57 abutting the back side of the key top 57.

A plurality of first and second lever sections 54 and 55, a plurality of key tops 56 mounted on these lever sections 54 and 55, and a plurality of elastic members 57, described above, are arranged on the switch section in a plurality of rows.

In this keyboard device, constructed as described above, when the key top 56 is depressed, the protrusions 54*a* and 55*a* of the first and second lever sections 54 and 55 rotate within the holding sections 53*a* and 56*a*, and the protrusions 54*b* and 55*b* slide within the slide grooves 53*b* and 56*b*. With the above rotation and sliding, the first and second lever sections 54 and 55 move downwards and, at the same time, the key top 56 also moves downwards. When the elastic member 57 is depressed by the key top 56 and the dome-like elastic member 57 is thereby deformed to flip over, the switch board 52 is depressed by the elastic member 57, and a circuit contact on the switch board 52 is brought into contact with the conductor on the insulating board 50, whereby the switch is turned ON.

After this, the depression of the key top 56 is cancelled, and the first and second lever sections 54 and 55 and the key top 56 are restored to the state before the depression due to the elasticity of the elastic member 57, and, at the same time, the switch board 52, which has been depressed by the elastic member 57, is restored to the former state due to its restoring capacity, and brought out of contact with the insulating board 50, whereby the switch is turned OFF.

The depression of the key top 56 by the operator is not uniform. When end portions (the upper and lower end portions in FIG. 6) of the key top 56 is depressed, the fork-like arm portions 54*d* and the protrusions 54*b* provided at the end thereof, which has a low level of strength, are deflected to a large extent, as shown in FIG. 7, and greatly inclined to positions Y and Z indicated by the dot lines. This great inclination leads to an inclination of the key top 56, thereby greatly affecting the operability.

In the conventional keyboard device, the arm portions 54*d* of the first lever portion 54 are formed in a fork-like configuration, and protrusions 54*b* are provided at the forward end thereof to engage engagement sections 53*c*, so that the arm portions 54*d* and the protrusions 54*b* are rather weak, and when an end portion of the key top 56 is depressed, the key top 56 is greatly deflected and inclined to a large degree, resulting in a poor operability. In addition, due to this great inclination, the protrusions 54*b* cannot slide smoothly in the slide grooves 53*b*, resulting in a poor operability.

Further, since the protrusions 54*b* of the first lever section 54 are mounted on the support member 53, which means their height is rather large due to the thickness of the support member 53, resulting in a problem in terms of thickness.

SUMMARY OF THE INVENTION

As a first means for solving the above problems, there is provided a keyboard device comprising: a key top; a first lever section whose one end is slidably held by an engagement section of a support member and whose other end is rotatably held by a holding section of the above-mentioned key top; and a second lever section whose one end is rotatably held by a holding section of the above-mentioned support member and whose other end is slidably supported by and engagement section of the above-mentioned key top, wherein the above-mentioned first and second lever sections are combined with each other in a crossing manner through a shaft member, wherein arm portions formed at an interval are provided at one end or at the other end of the above-mentioned first or second lever section, and wherein a connecting section for connecting the end portions of these arm portions is provided at the end of these arm portions, this connecting section being engaged with the engagement section of the above-mentioned support member or the above-mentioned key top provided a keyboard device, wherein the above-mentioned connecting section is provided with an extension connected to the end portion thereof.

Further, as a third means for solving the above problems, there is provided a keyboard device, wherein the above-mentioned connecting section is constructed such that it is placed on a switch board so as to be slidable.

DESCRIPTION OF THE PREFERRED EMBODIMENT

Figure 1:
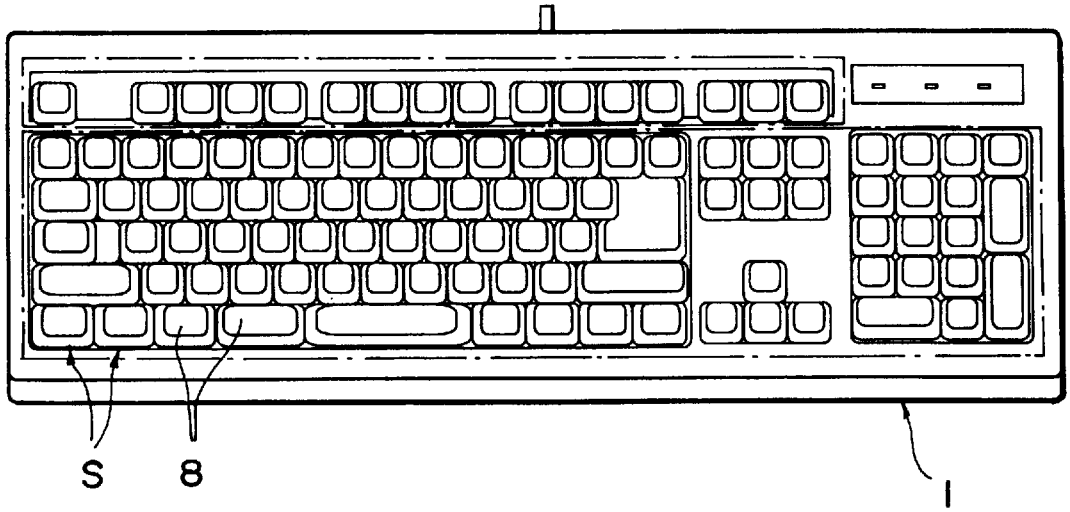
FIG. 1 is a plan view of a keyboard device according to the present invention.

An embodiment of the keyboard device of the present invention will now be described in detail with reference to FIGS. 1 through 4. As shown in FIG. 1, in a casing 1 of the keyboard device, a plurality of key switches S are arranged in each of a plurality of lines.

Figure 2:
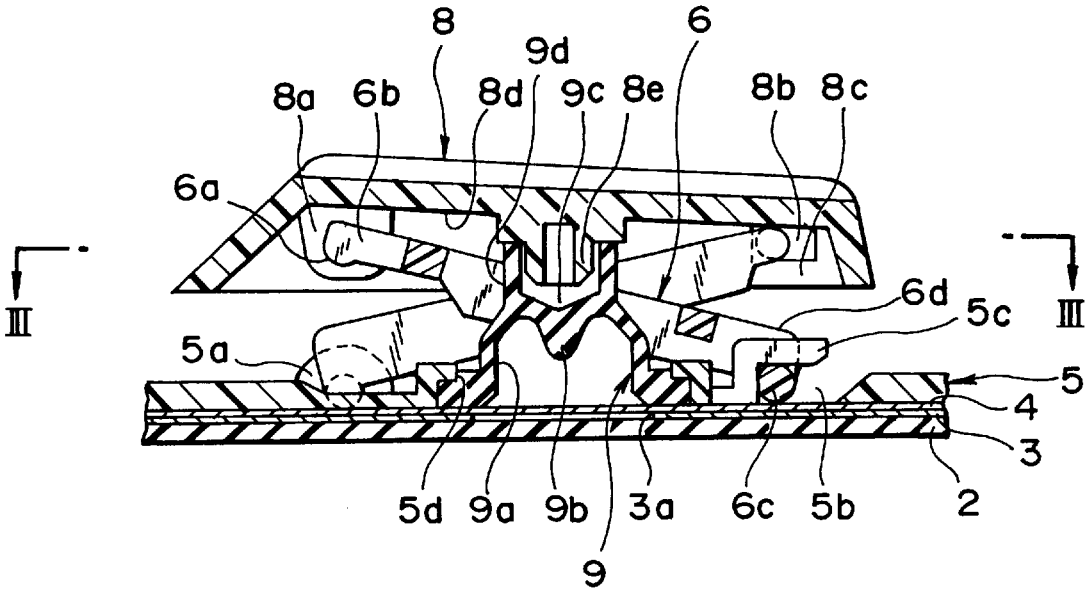
FIG. 2 is a sectional view of an essential part of the keyboard device of the present invention.
Figure 3:
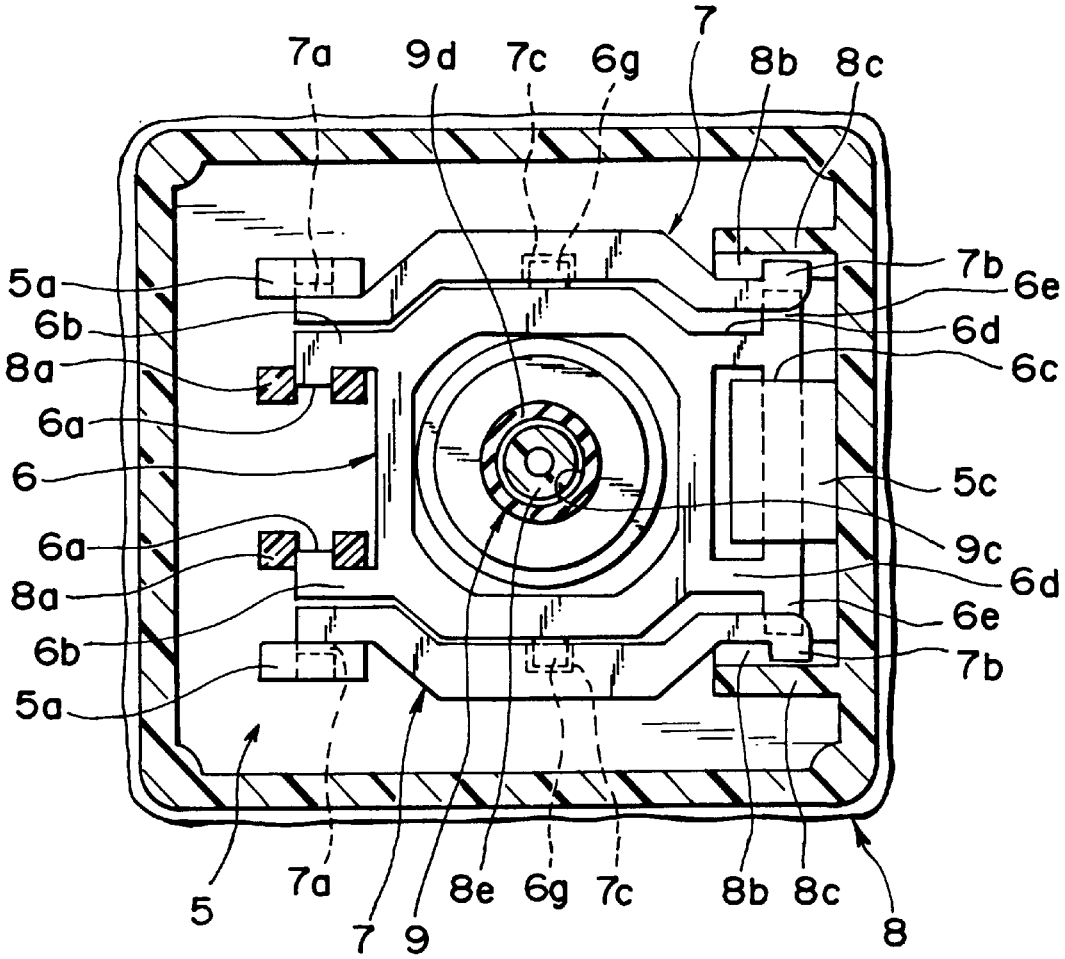
FIG. 3 is a sectional view taken along the line A—A of FIG. 2, showing the keyboard device of the present invention.

As shown in FIGS. 2 and 3, each of these key switches S is equipped with a switch section, which is formed by placing switch board 4 consisting of a flexible insulating material equipped with a circuit (not shown) on an insulating board 2 equipped with a conductor (not shown) through the intermediation of a plate-like spacer 3 formed of an insulating material and having a hole 3*a*.

Further, a support member 5 formed of a synthetic resin includes two holding sections 5*a* equipped with an arcuate recess and formed at an interval, an engagement section 5*c* spaced apart from the holding sections 5*a* and equipped with a slide groove 5*b*, and a circular hole 5*d* provided between the engagement section 5*c* and the holding section 5*a*. This support member 5 is placed on the switch board 4 and mounted thereto. When it is mounted, the slide groove 5*b* is exposed on the switch board 4.

A substantially H-shaped first lever section 6 formed of a synthetic resin is equipped with a pair of arm portions 6*b* arranged at one end and having round protrusions 6*a*, a pair of arm portions 6*d* which are arranged at the other end and whose end portions are connected together by a round bar-like connecting portion 6*c*, extending portions 6*e* connected to the connecting portion 6*c* and axially protruding from both ends of the connecting portion 6*c*, a central hollow portion 6*f*, and shaft members 6*g* provided between one and the other end and protruding outwardly, wherein the connecting portion 6*c* is supported by the engagement section 5*c* of the support member 5 and can slide within the slide groove 5*b* on the switch board 4.

Each of a pair of second lever sections 7 consisting of a synthetic resin has at its ends round protrusions 7*a* and 7*b* and a recess 7*c* provided between the protrusions 7*a* and 7*b*. The protrusion 7*a* is fitted into the arcuate recess of the holding section 5*a* of the holding member 5, with a part of it being in contact with the switch board 4. Further, the shaft members 6*g* of the first lever section 6 are fitted into the recesses 7*c*, whereby the first and second lever sections 6 and 7 are rotatably combined in a crossing manner.

A ship-shaped key top 8 formed of a synthetic resin has on its back side two holding sections 8*a* each having a hole, two L-shaped engagement sections 8*c* each having a slide groove 8*b*, and a protrusion 8*e* provided substantially at the center of the back side 8*d*.

The protrusions 6*a* of the first lever section 6 are rotatably fitted into the holes of the above-mentioned holding sections 8*a*, and the protrusions 7*b* of the pair of second lever sections 7 are slidably fitted into the slide grooves 8*b* of the engagement sections 8*c*, and, in this way, the key top 8 is mounted by means of the first and second lever sections 6 and 7.

As shown in FIGS. 2 and 3, a dome-like elastic member 9 formed of an insulating rubber is equipped with a body portion 9*a*, a protrusion 9*b* provided in the body portion 9*a*, and a top portion provided on top of the body portion 9*a* and having a recess 9*c*.

This elastic member 9 is positioned inside the hole 5*d* of the support member 5, and a part of it is held between the switch board 4 and the support member 5, whereby the elastic member 9 is prevented from moving vertically or horizontally. The body portion 9*a* and the top portion 9*d* are positioned inside the hollow portion 6*c* of the first lever section 6 and, in this condition, the protrusion 8*e* of the key top 8 is fitted into the recess 9*c* of the top portion 9*d*. Further, the forward end of the top portion 9*d* abuts the back side 8*d* of the key top 8, and, due to the elasticity of the elastic member 9, the key top 8 is normally held up.

As described above, each key switch S is composed of a switch section, first and second lever sections 6 and 7, a key top 8 and an elastic member 9.

Next, the operation of the keyboard device, constructed as described above, will be described.

First, when the key top 8 is depressed against the elasticity of the elastic member 9, the elastic member 9 is deformed by degrees. At a certain point in time, the dome-like body portion 9*a* flips over, and, in this process, the contact on the switch board 4 is brought into contact with the conductor on the insulating board 2, whereby the switch is turned ON.

At this time, the protrusion 8*e* of the key top 8 enables the elastic member 9 to be correctly depressed due to the construction in which it is fitted into the recess 9*c* of the elastic member 9.

In this process, the first and second lever sections 6 and 7 are rotated around the shaft members 6*g*, one end of each of the first and second lever sections 6 and 7 being rotated in the holding sections 5*a* and 8*a* and the other end thereof sliding within the slide grooves 5*b* and 8*b*. In the course of this movement, the first and second lever sections 6 and 7 move downwards, and the key top 8 also moves downwards. When, after the turning ON of the switch, the depression of the key top 8 is cancelled, the key top 8 and the first and second lever sections 6 and 7 are restored to the condition before the depression due to the elasticity of the elastic member 9. At the same time, the switch board 4, which has been depressed by the elastic member 9, is restored to the former state due to its own restoring force, and it is brought out of contact with insulating board 2, whereby the switch is turned OFF.

Figure 4:
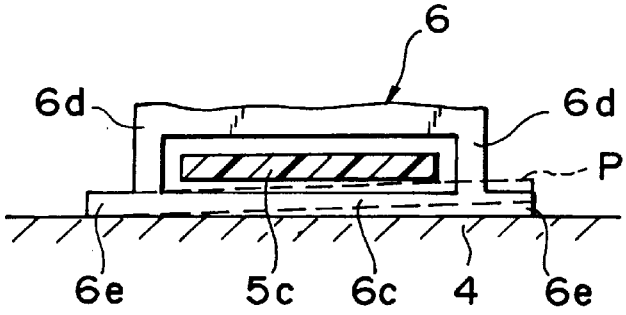
FIG. 4 is a schematic diagram illustrating the operation of the keyboard device of the present invention.
Figure 5:
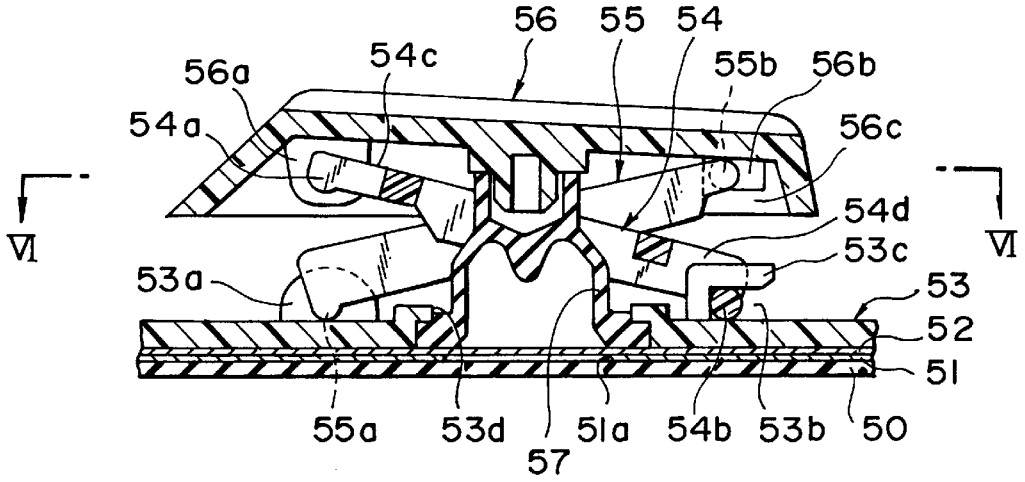
FIG. 5 PRIOR ART
FIG. 5 is a sectional view of an essential part of a conventional keyboard device.
Figure 6:
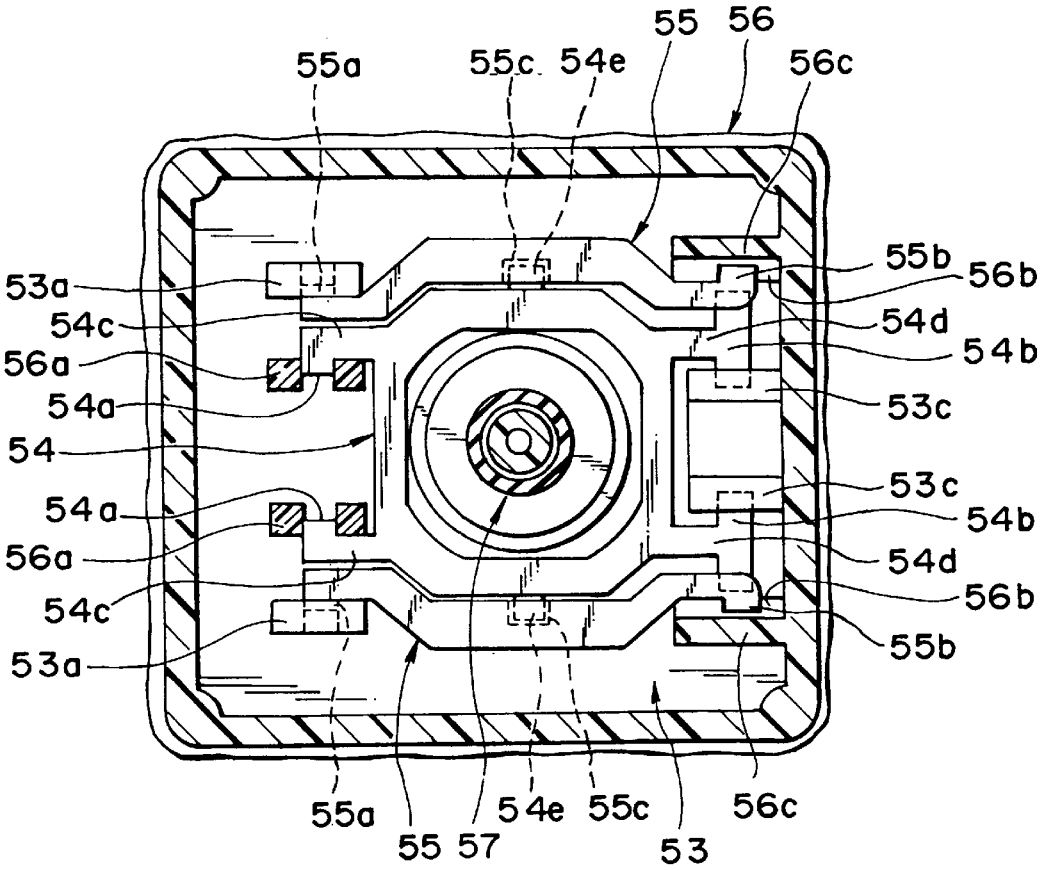
FIG. 6 PRIOR ART
FIG. 6 is a sectional view taken along the line B—B of FIG. 5, showing the conventional keyboard device.
Figure 7:
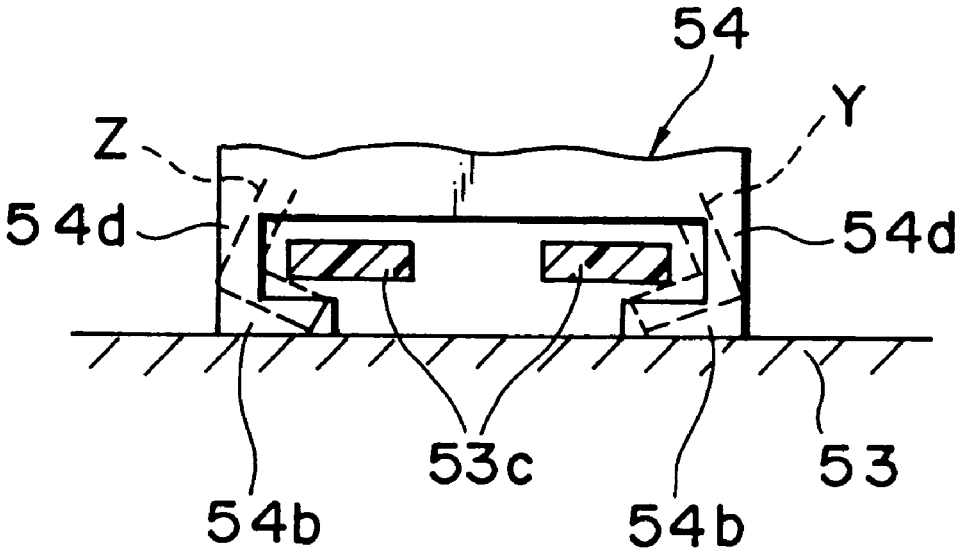
FIG. 7 PRIOR ART
FIG. 7 is a schematic diagram illustrating the operation of the conventional keyboard device.

FIG. 4 illustrates the operation of the keyboard device of the present invention. The portion of the key top 8 depressed by the operator is unpredictable. When one of the end portions (the upper and lower portions in FIG. 3) of the key top 8 is depressed, the pair of arm portions 6*d*, which have been increased in strength due to the connection by the connecting section 6*c*, undergo little deflection. Further, due to the extending portions 6*e*, their inclination until they abut the engagement section 5*c* is small as shown by the position P indicated by the dotted line.

Since the clearance in the height of the slide groove has to be relatively large, the inclination of the lever sections is relatively large on the slide groove side. The present invention attains an improvement in this regard.

While the above embodiment has been described with reference to a structure in which the engagement section having a slide groove is provided on the support member, the present invention is naturally also applicable to a structure in which the engagement section is provided on the key top.

In accordance with the present invention, arm portions formed at an interval are provided at one or the other end of a first or second lever section, and, at the end of these arm portions, a connecting section for connecting their ends is provided, wherein this connecting section is engaged with an engagement section of the key top, whereby the strength of the end portions of the arm portions is increased, and the deflection of the arm portions can be reduced, so that the inclination when the key top is depressed is relatively small, thereby making it possible to provide a keyboard device having a satisfactory operability.

Further, in accordance with the present invention, the connecting section is provided with an extending portion connected to the end thereof, so that is possible to reduce the inclination until the connecting section abuts the engagement section, whereby it is possible to provide a keyboard device in which the inclination when the key top is depressed can be reduced to thereby achieve an improvement in operability and in which the connecting section can move smoothly to thereby achieve an improvement in terms of feel in operation. Further, in accordance with the present invention, the connecting section is slidably placed on the switch board, so that an improvement can be achieved in terms of thickness by the thickness of the support member, whereby it is possible to provide a thin keyboard device.

What is claimed is:

1. A keyboard device comprising:

a key top;

a first lever section having a first end and a second end, said first end comprising a pair of spaced apart arm portions slidably held by an engagement section of a support member and said second end being rotatably held by a holding section of said key top; and a second lever section having a first end and a second end, said first end being rotatably held by a holding section of said support member and said second end being slidably supported by an engagement section of said key top, wherein said first and second lever sections are combined with each other in a crossing manner through a shaft member, wherein at the first end of said first lever section there is provided a connecting bar that connects the pair of arm portions together, and wherein said connecting bar is slidably engaged with a slide groove of said engagement section, said slide groove being formed by the lower side of an engagement surface extending in the direction in which the first end of said first lever slides and expanding in the direction in which said connecting bar extends.

2. A keyboard device according to claim 1, wherein said arm portions of said first lever further comprise an extending portion which protrudes outwardly from each said arm portion in an axial direction parallel to that of said connecting bar.

3. A keyboard device according to claim 1, wherein said connecting bar is slidably placed on a switch board.

4. A keyboard device according to claim 2, wherein said connecting bar is slidably placed on a switch board.

* * * * *